US005976614A

United States Patent [19]

Bhattacharya et al.

[11] Patent Number: 5,976,614

[45] Date of Patent: Nov. 2, 1999

[54] PREPARATION OF CUXINYGAZSEN PRECURSOR FILMS AND POWDERS BY ELECTROLESS DEPOSITION

[75] Inventors: Raghu N. Bhattacharya, Littleton; Wendi Kay Batchelor, Lakewood; Holm Wiesner, Golden; Kannan Ramanathan, Golden; Rommel Noufi, Golden, all of Colo.

[73] Assignee: Midwest Research Institute, Kansas City, Mo.

[21] Appl. No.: 09/170,840

[22] Filed: Oct. 13, 1998

[51] Int. Cl.[6] ..... B05D 5/12

[52] U.S. Cl. ..... 427/98; 427/305; 427/437; 427/443.1

[58] Field of Search ..... 106/1.22, 1.23, 106/1.25, 1.26; 205/239; 427/98, 305, 437, 443.1

[56] References Cited

U.S. PATENT DOCUMENTS

| | | | |
|---|---|---|---|
| 4,720,404 | 1/1988 | Culjkovic | 427/98 |
| 4,908,241 | 3/1990 | Quast et al. | 427/437 |
| 5,158,604 | 10/1992 | Morgan et al. | 106/1.23 |
| 5,436,204 | 7/1995 | Albin et al. | 437/225 |

FOREIGN PATENT DOCUMENTS 120479 5/1996 Japan .

OTHER PUBLICATIONS

Grant & Hackh's Chemical Dictionary, p. 204, 1987.

*Primary Examiner*—Brian K. Talbot
*Attorney, Agent, or Firm*—Ken Richardson

[57] ABSTRACT

A method for electroless deposition of $Cu_xIn_yGa_zSe_n$ (x=0–2, y=0–2, z=0–2, n=0–3) precursor films and powders onto a metallic substrate comprising:

preparing an aqueous bath solution of compounds selected from the group consisting of:

I) a copper compound, a selenium compound, an indium compound and gallium compound; II) a copper compound, a selenium compound and an indium compound; III) a selenium compound, and indium compound and a gallium compound; IV) a selenium compound and a indium compound; and V) a copper compound and selenium compound; each compound being present in sufficient quantity to react with each other to produce $Cu_xIn_yGa_zSe_n$ (x=0–2, y=0–2, z=0–2, n=0–3);

adjusting the pH of the aqueous bath solution to an acidic value by the addition of a dilute acid; and initiating an electroless reaction with an oxidizing counterelectrode for a sufficient time to cause a deposit of $Cu_xIn_yGa_zSe_n$ (x=0–2, y=0–2, z=0–2, n=0–3) from the aqueous bath solution onto a metallic substrate.

19 Claims, 4 Drawing Sheets

PREPARATION OF CUXINYGAZSEN PRECURSOR FILMS AND POWDERS BY ELECTROLESS DEPOSITION

CONTRACTUAL ORIGIN OF THE INVENTION

This United States Government has rights in this invention pursuant to Contract No. DE-AC3683CH10093 between the U.S. Department of Energy and the National Renewable Energy Laboratory, a Division of Midwest Research Institute.

BACKGROUND OF THE INVENTION

1. Field of the Invention

The invention relates to an electroless deposition of film on molybdenum coated glass or other conducting substrates. The process does not need any external current or voltage source for the specific deposition of Cu(In,Ga)—$(Se,S)_2$ materials, and uses Fe or Zn, or Al for the source of counterelectrodes to initiate the electroless deposition of film, which is used for making photovoltaic devices.

2. The Prior Art

Thin-films of copper-indium-diselenide ($CuInSe_2$), copper-gallium-diselenide ($CuGaSe_2$) and copper-indium-gallium-diselenide ($CuIn_{1-x}Ga_xSe_2$), all of which are sometimes generically referred to as $Cu(In,Ga)Se_2$, have become the subject of considerable interest and study for semiconductor devices. Sulphur can also be used, and sometimes is, substituted for selenium, and the compound is sometimes also referred to even more generically as Cu(In,Ga)—$(Se,S)_2$ to comprise all of those possible combinations. These compounds are of particular interest for photovoltaic device or solar cell absorber applications because of solar energy to electrical energy conversion efficiencies that have been shown to exceed seventeen percent (17%) in active areas and to approach seventeen percent (17%) in total areas, which is high for current state-of-the-art solar cell technologies. It has been generally believed by persons skilled in this art that the best electronic device properties, and thus the best conversion efficiencies, are obtained when the mole percent of copper is about equal to the mole percent of the indium, the gallium, or the combination of the indium and gallium in the $Cu(In,Ga)Se_2$ compound or alloy. The selenium content will not generally be important to the electronic properties of the semiconductor if the growth conditions supply sufficient selenium so that it comprises about fifty atomic percent (50 at. %) of the $Cu(In,Ga)Se_2$ compound to form the desired crystal lattice structures.

A physical vapor deposition recrystallization method for selenization of thin-film $Cu(In,Ga)Se_2$ is disclosed in U.S. Pat. No. 5,436,204, and entails depositing thin-film metal precursors Cu+(In,Ga) in a Cu-rich ratio of Cu/(In,Ga)>1 on a substrate, annealing the precursors at a moderate temperature (about 450° C.) in the presence of a Se overpressure to form thin-film $Cu(In,Ga)Se_2$:$Cu_xSe$ phase-separated mixtures, adding an (In,Ga) vapor exposure to the thin-film phase-separated mixtures in the Se overpressure while ramping the temperature up from the moderate temperature to a higher recrystallization temperature (about 550° C.), maintaining the thin-film in the Se overpressure at the higher recrystallization temperature for a period of time to allow the $Cu_xSe$ and In,Ga+Se to form a slightly Cu-poor thin-film $Cu_x(In,Ga)_ySe_z$ compound, and then ramping down the temperature of the thin-film while maintaining the Se overpressure.

U.S. Pat. No. 4,720,404 disclose the use of an aqueous alkaline bath for the adhesive chemical (electroless) deposition of copper, nickel, cobalt or their alloys with great purity, containing compounds of these metals, reducing agent, wetting agent, pH-regulating substance, stabilizer, inhibitor and complex former, characterized in that polyols and/or compounds of the biuret type are contained as complex former, as well as a method for the adhesive chemical deposition of the metals, employing this bath at a temperature from 5° C. up to the boiling point of the bath, for the manufacture of printed circuits.

An electroless plating solution is disclosed in U.S. Pat. No. 5,158,604 in a process to plate copper and nickel. This process is accomplished by depositing metal onto a substrate which is catalytic to the electroless deposition of metal, and entails coating onto the substrate a layer of thixotropic viscous aqueous electroless plating solution comprising at least one ionic depositable metal species selected from groups 1B and 8 of the Periodic Chart of the Elements and chromium, at least one metal complexing agent present in molar excess of the depositable metal species, at least one reducing agent present in molar excess of the depositable metal species and sufficient thickener to provide a viscosity at 25° C. which is in the range of 50 to 20,000 cp viscosity; wherein the viscosity of the solution is low enough to allow hydrogen gas generated by the deposition of metal to release from a catalytic substrate surface at a rate sufficient to allow the deposition of at least a 40 nanometer thick layer of metal onto a palladium catalyzed surface in less than 3 minutes.

U.S. Pat. No. 4,908,241 disclose a process for the currentless deposition of electropositive metal layers onto appropriate less electropositive metals by contacting an object to be coated with a coating bath, wherein a coating bath is used which contains a metal complex obtained by reacting a monovalent electropositive metal halide with a base, which is capable of complex formation with the electropositive metal, and a hydrohalic acid.

There is a need in the art of preparing $Cu_xIn_yGa_zSe_n$ precursor films and powders for use in semiconductor device applications to prepare these films and powders by an electroless deposition process. The reason for need of an electroless deposition process is that such a process would provide:

- a low cost, high rate process;
- a large area, continuous, multi-component, low temperature deposition method;
- deposition of films on a variety of shapes and forms (wires, tapes, coils, and cylinders);
- freedom from the requirement or need to use equipment;
- controlled deposition rates and effective material utilization; and
- minimum waste generation (solution can be recycled)

SUMMARY OF THE INVENTION

One object of the present invention is to provide a process for preparing $Cu_xIn_yGa_zSe_n$ (CIGS) precursor films and powders by way of an electroless process to provide a low cost, high rate process.

Another object of the present invention is to provide a large area, continuous, multi=component, low temperature deposition method that is electroless for preparation of $Cu_xIn_yGa_zSe_n$ precursor films and powders.

A further object of the present invention is to provide an electroless deposition process for preparation of $Cu_xIn_yGa_zSe_n$ precursor films and powders for depositing films on a variety of shapes and forms (wires, tapes, coils, and cylinders).

A yet further object of the present invention is to provide an electroless deposition process for preparation of $Cu_xIn_yGa_zSe_n$ precursor films and powders that require no equipment.

A still further object of the present invention is to provide a process for preparing $Cu_xIn_yGa_zSe_n$ precursor films and powders by electroless deposition using controlled deposition rates and effective material utilization.

A further object yet still of the present invention is to provide an electroless deposition process for preparing $Cu_xIn_yGa_zSe_n$ precursor films and powders utilizing a minimum waste generation (the solution can be recycled).

In general, the invention process for preparing $Cu_xIn_yGa_zSe_n$ precursor films and powders is accomplished by the combination of electrochemical and chemical reactions from a specific solution mixture for the specific deposition ($Cu^{2+}$, $In^{3+}$,$Ga^{3+}$+e→Cu. In, Ga; $H_2SeO_3$+4H$^+$+4e→Se+3$H_2O$; Cu, In, Ga+Se→Cu—In—Ga—Se). The electrochemical reaction is initiated by a counterelectrode of Fe or Zn (oxidation reaction: Fe or Zn, or Al →(Fe or Zn)$^{2+}$+2e). Cu, In, Ga, and $H_2SeO_3$ are reduced (deposited) in a specific solution mixture in the presence of Fe or Zn. The invention process does not need any external current or voltage source to obtain the specific deposition of Cu—In—Ga—Se, Cu—In—Se, In—Se, Cu—Se. The deposited precursor materials are used to make photovoltaic devices. A solar cell made by the invention process has a device efficiency of 9.28%.

DETAILED DESCRIPTION OF THE INVENTION

Figure 1:
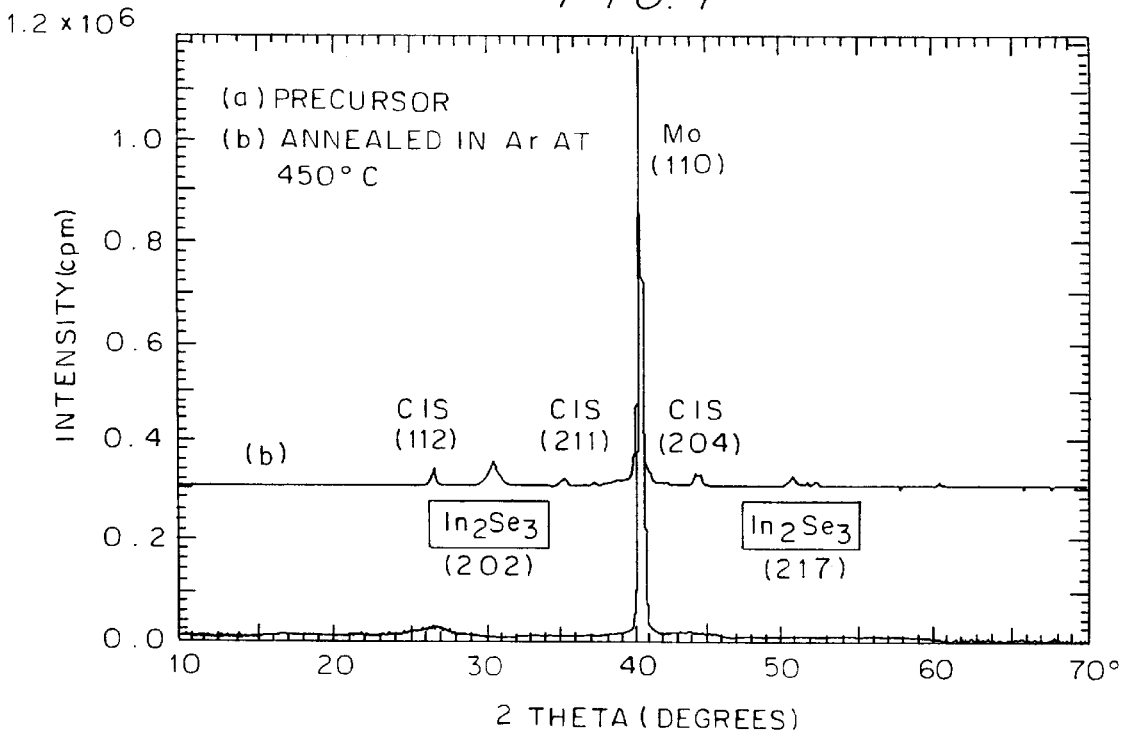
FIG. 1 is a graph of X-ray diffraction data of (a) as-deposited precursor films and (b) annealed films of $CuIn_{1.48}$ $Se_{2.17}$.

The processes of the present invention comprise the steps of preparing electroless depositions of $Cu_xIn_yGa_zSe_n$ (x=0–2, y=0–2, z=0–2, n=0–3) precursor films and powders.

In preparing the electroless deposition of $Cu_xIn_yGa_zSe_n$ (x=0–2, y=0–2, z=0–2, n=0–3) precursor films and powders of the invention, Fe or Zn is used as counterelectrode to initiate the electroless deposited precursor films that are used to fabricate solar cells.

The electroless deposition of $Cu_xIn_yGa_zSe_n$ films is caused by the combination of electrochemical and chemical reactions as follows:

Reduction: $M^{n+}+ne^- \rightarrow M$, $H_2SeO_3+4H^++4e^- \rightarrow Se+3H_2O$ $xM+ySe \rightarrow M_xSe_y$ Oxidation: $N \rightarrow N^{n+}+ne^{31}$ The most electropositive redox system (e.g., Cu, In, Ga, $H_2SeO_3$ or $SeO_2$) are reduced (deposited).

To control the potential, an external resistor can be applied, and the $E^0$ vs SHE for controlling the potential external resistor in providing electroless deposition of $Cu_xIn_yGa_zSe_n$ is governed by the following:

$E^0$ vs SHE $Cu^++e \rightarrow Cu$ 0.521

$Cu^{2+}+2e \rightarrow Cu$ 0.342

$In^{3+}+3e \rightarrow In$ −0.338

$Ga^{3+}+3e \rightarrow Ga$ −0.549

$H_2SeO_3+3H_2O+4e \rightarrow Se+6OH^- \rightarrow$ −0.366

$Zn^{2+}+2e \rightarrow Zn$ −0.763

$Fe^{2+}+2e \rightarrow Fe$ −0.447

$Al^{3+}+3e \rightarrow Al$ −1.662

The following examples will show the deposition of $Cu_xIn_yGa_zSe_n$ (x=0–2, y=0–2, z=0–2, n=0–2) on a metallic substrate, for which an oxidizing electrode such as Fe, Zn or Al is used as the counterelectrode to initiate electroless deposition.

EXAMPLE 1

Example: Deposition of $CuIn_{0.40}Ga_{0.31}Se_{2.17}$

A bath solution was prepared by mixing 0.35 gm $CuCl_2$+0.8 gm $H_2SeO_3$+3 gm $InCl_3$+1.2 gm $GaCl_3$+10 gm LiCl in 860 ml of water at ambient temperature, and the pH of this bath was adjusted to 2.4 by adding incremental amounts of dilute HCl. The pH adjusted solution was coated on glass substrates coated with molybdenum and iron foil was used as a counterelectrode to initiate electroless deposition.

Inductively coupled plasma (ICP) analysis revealed that the as-deposited film was $CuIn_{0.40}Ga_{0.31}Se_{2.17}$.

In the device fabrication, the as-deposited electroless films are loaded in a physical evaporation chamber, where additional In, Ga, and Se are added by physical vapor deposition (PVD) to the film to adjust the final composition to $CuIn_{1-x}Ga_xSe_2$, and they are allowed to crystallize at high temperature. At present, addition of In and Ga by physical vapor deposition and also selenization at high temperature are very crucial steps to obtain high-efficiency devices.

The substrate (precursor film) temperature during the PVD step was 550°±10° C. The duration of annealing at this stage varies from 10 to 20 minutes. The films were also selenized by exposure to selenium vapor during the cool-down time (~40° C./min).

Photovoltaic devices were completed by chemical-bath deposition of about 500 ÅCdS, followed by radio-frequency (RF) sputtering of 500 Å of intrinsic ZnO and 3500 Å of $Al_2O_3$—doped conducting ZnO. Bilayer Ni/Al top contacts were deposited in an e-beam system.

EXAMPLE 2

Example: Deposition of $CuIn_{0.34}Ga_{0.11}Se_{1.99}$

A bath solution was prepared by mixing 0.7 gm $CuCl_2$+1.6 gm $H_2SeO_3$+6 gm $InCl_3$+2.4 gm $GaCl_3$+10 gm LiCl in 860 ml water at ambient temperature, and the pH was adjusted to 2.24 by adding incremental amounts of dilute HCl. The pH adjusted solution was coated on glass substrates coated with molybdenum and iron foil was used as a counterelectrode to initiate electroless deposition.

ICP analysis revealed that the as-deposited film was $CuIn_{0.34}Ga_{0.11}Se_{1.99}$.

EXAMPLE 3

Example: Deposition of $CuIn_{0.54}Ga_{0.81}Se_{1.82}$

A bath solution was prepared by mixing 0.35 gm $CuCl_2$+0.8 gm $H_2SeO_3$+3 gm $InCl_3$+1.2 gm $GaCl_3$+10 gm LiCl in 860 ml water at ambient temperature, and the pH was adjusted to 2.5 by adding incremental amounts of dilute HCl. The pH adjusted solution was coated on glass substrates coated with molybdenum and zinc foil was used as a counterelectrode to initiate electroless deposition.

ICP analysis revealed that the as-deposited film was $CuIn_{0.54}Ga_{0.8}Se_{1.82}$.

EXAMPLE 4

Example: Deposition of $CuIn_{2.39}Se_{2.82}$.

A bath solution was prepared by mixing 0.35 gm $CuCl_2$+0.8 gm $H_2SeO_3$+3 gm $InCl_3$+10 gm LiCl in 850 ml water at ambient temperature, and the pH of this bath was adjusted to 2.75 by adding incremental amounts of dilute HCl. The pH adjusted solution was coated on glass substrates coated with molybdenum and zinc foil was used as a counterelectrode to initiate electroless deposition.

ICP analysis revealed that the as-deposited film was $CuIn_{2.39}Se_{2.82}$.

EXAMPLE 5

Example: Deposition of $CuIn_{1.48}Se_{2.17}$

A bath solution was prepared by mixing 0.35 gm $CuCl_2$+0.8 gm $H_2SeO_3$+3 gm $InCl_3$+10 gm LiCl in 850 ml water at ambient temperature, and the pH of the bath was adjusted to 2.75 by adding incremental amounts of dilute HCl. The pH adjusted solution was coated on glass substrates coated with molybdenum and Iron foil was used as a counterelectrode to initiate electroless deposition.

ICP analysis revealed that the as-deposited film was $CuIn_{1.48}Se_{2.17}$. FIG. 1*a* shows x-ray diffraction data of as-deposited films which are amorphous in nature. FIG. 1*b* shows x-ray diffraction data of the same film annealed in Ar at 450° C. The annealed film shows the phase development of $In_2Se_3$ and $CuInSe_2$.

EXAMPLE 6

Example: Deposition of $InGa_{1.78}Se_{3.12}$

A bath solution was prepared by mixing 0.8 gm $H_2SeO_3$+3 gm $InCl_3$+1.2 gm $GaCl_3$+10 gm LiCl in 860 ml water at ambient temperature, and the pH of this bath was adjusted to 2.5 by adding incremental amounts of dilute HCl. The pH adjusted solution was coated on glass substrates coated with molybdenum and zinc foil was used as a counterelectrode to initiate electroless deposition.

ICP analysis revealed that the as-deposited film was $InGa_{1.78}Se_{3.12}$.

EXAMPLE 7

Example: Deposition of $InGa_{2.69}Se_{8.69}$

A bath solution was prepared by mixing 0.8 gm $H_2SeO_3$+3 gm $InCl_3$+1.2 gm $GaCl_3$10 gm LiCl in 860 ml water at ambient temperature, and the pH of this bath was adjusted to 2.55 by adding incremental amounts of dilute HCl. The pH adjusted mixture solution was coated on glass substrates coated with molybdenum and iron foil was used as a counterelectrode to initiate electroless deposition.

ICP analysis revealed that the as-deposited film was $InGa_{2.69}Se_{8.69}$.

EXAMPLE 8

Example: Deposition of $InGa_{0.54}Se_{4.7}$

A bath solution was prepared by mixing 0.8 gm $H_2SeO_3$+3 gm $InCl_3$+1.2 gm $GaCl_3$+10 gm LiCl in 860 ml water at ambient temperature, and the pH of this solution was adjusted to 2.55 by adding incremental amounts of dilute HCl. The pH adjusted solution was coated on a substrate of silver and iron foil was used as a counterelectrode to initiate electroless deposition.

ICP analysis revealed that the as-deposited film was $InGa_{0.54}Se_{4.7}$.

EXAMPLE 9

Example: Deposition of $InSe_{2.20}$

A bath solution was prepared by mixing 0.8 gm $H_2SeO_3$+3 gm $InCl_3$+10 gm LiCl in 850 ml water at ambient temperature, and the pH of the this solution was adjusted to 2.66 by adding incremental amounts of dilute HCl. The pH adjusted solution was coated on a glass substrate coated with molybdenum and iron foil was used as a counterelectrode to initiate electroless deposition.

ICP analysis revealed that the as-deposited film was $InSe_{2.20}$.

EXAMPLE 10

Example: Deposition of $InSe_{1.77}$

A bath solution was prepared by mixing 0.8 gm $H_2SeO_3$+3 gm $InCl_3$+10 gm LiCl in 850 ml water at ambient temperature, and the pH of this solution was adjusted to 2.66 by adding incremental amounts of dilute HCl. The pH adjusted solution was coated on a substrate of silver and iron foil was used as a counterelectrode to initiate electroless deposition.

ICP analysis revealed that the as-deposited film was $InSe_{1.77}$.

EXAMPLE 11

Example: Deposition of $InSe_{1.25}$

A bath solution was prepared by mixing 0.8 gm $H_2SeO_3$+3 gm $InCl_3$+10 gm LiCl in 860 ml water at ambient temperature, and the pH of this solution was adjusted to 2.65 by adding incremental amounts of dilute HCl. The pH adjusted solution was coated on a substrate of silver and zinc foil was used as a counterelectrode to initiate electroless deposition.

ICP analysis revealed that the as-deposited film was $InSe_{1.25}$.

EXAMPLE 12

Example: Deposition of InSe

A bath solution was prepared by mixing 0.8 gm $H_2SeO_3$+3 gm $InCl_3$+10 gm LiCl in 850 ml water at ambient temperature, and the pH of this solution was adjusted to 2.65 by adding incremental amounts of dilute HCl. The pH adjusted solution was coated on a substrate of molybdenum and zinc foil was used as a counterelectrode to initiate electroless deposition.

ICP analysis revealed that the as-deposited film was InSe.

EXAMPLE 13

Example: Deposition of $CuSe_{2.34}$

A bath solution composition was prepared by mixing 0.35 gm $CuCl_2$+0.8 gm $H_2SeO_3$+10 gm LiCl with 850 ml water at ambient temperature, and the pH of this solution was adjusted to 2.54 by adding incremental amounts of dilute HCl. The pH adjusted solution was coated on a substrate of molybdenum and zinc foil was used as a counterelectrode to initiate electroless deposition.

ICP analysis revealed that the as-deposited film was $CuSe_{2.34}$.

EXAMPLE 14

Example: Deposition of $CuSe_{1.30}$

A bath solution was prepared by mixing 0.35 gm $CuCl_2$+0.8 gm $H_2SeO_3$+10 gm LiCl in 850 ml water at ambient temperature, and the pH of this solution was adjusted to 2.75 by adding incremental amounts of dilute HCl. The pH adjusted solution was coated on a substrate of molybdenum and iron foil was used as a counterelectrode to initate electroless deposition.

Figure 2:
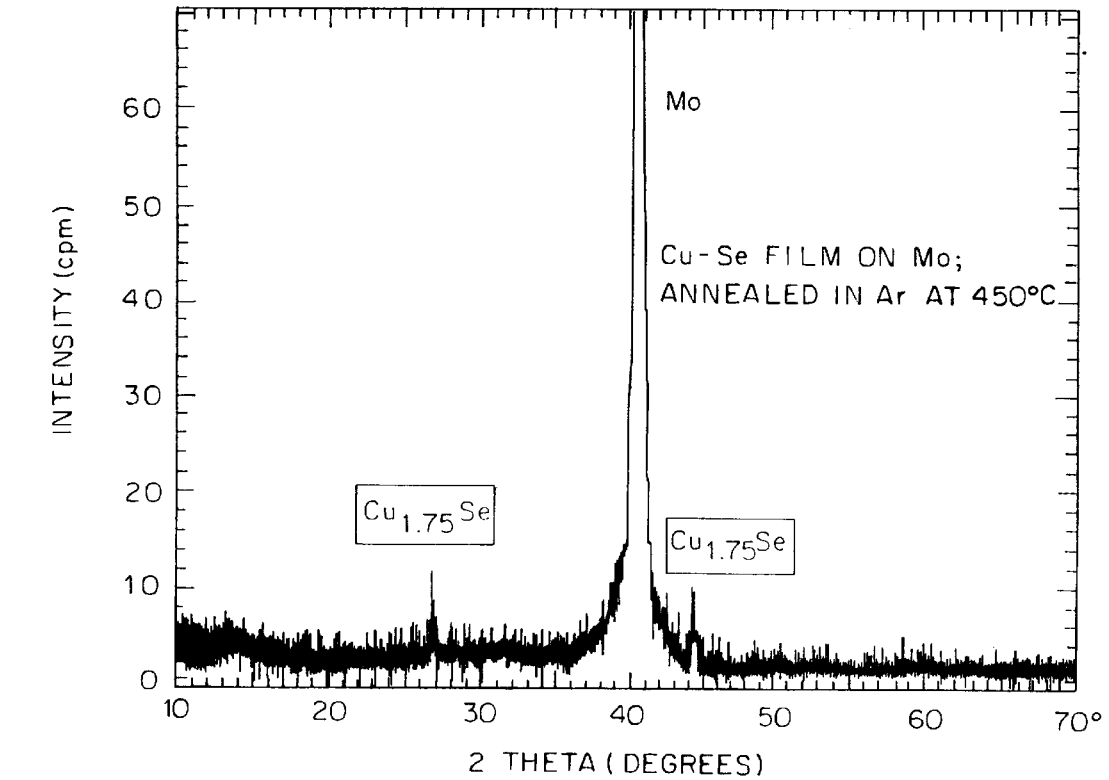
FIG. 2 is a graph of X-ray diffraction data of $CuSe_{1.30}$ film, as-deposited and annealed in Ar at 450° C.

ICP analysis revealed that the as-deposited film was $CuSe_{1.30}$. The as-deposited film was amorphous. The same film annealed in Ar at 450° C. showed the $Cu_{1.75}$ Se phase development (FIG. 2).

EXAMPLE 15

Example: Deposition of $CuIn_{0.42}Ga_{0.38}Se_{2.04}$

A bath solution was prepared by mixing 0.35 gm $CuCl_2$+0.8 gm $H_2SeO_3$+3 gm $InCl_3$+1.2 gm $GaCl_3$+10 gm LiCl in 860 ml of water at ambient temperature, and the pH of this solution was adjusted to 2.6 by adding incremental amounts of dilute HCl. The pH adjusted solution was coated on a substrate of molybdenum and iron foil was used as a counterelectrode to initiate electroless deposition.

Figure 3:
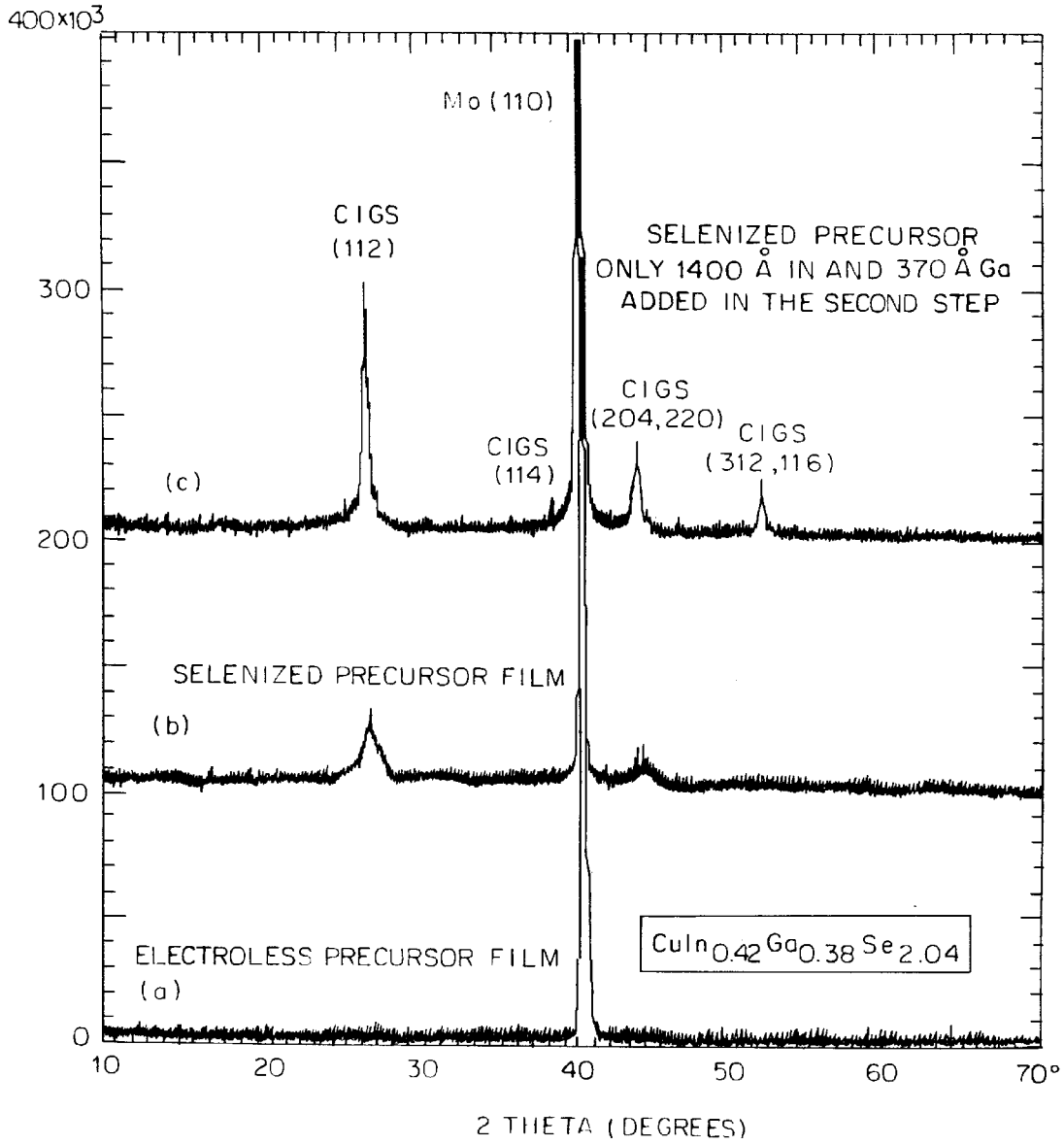
FIG. 3 is a graph of an X-ray diffraction showing data of (a) as-deposited precursor films and (b) selenized films of $CuIn_{0.42}Ga_{0.38}Se_{2.04}$ and (c) the absorber layer after the adjustment of the composition by physical evaporation.

FIG. 3 shows x-ray diffraction data of as-deposited precursor films and selenized films prepared according to this example. The selenized precursor film is annealed in a vacuum in the presence of selenium.

ICP analysis revealed that the as-deposited film was $CuIn_{0.42}Ga_{0.38}Se_{2.04}$. A solar cell was prepared using the procedure of Example 1. The device was fabricated with the addition of 1400 Å In and 370 Å Ga by a physical evaporation method.

There has been described, an electroless deposition process for preparation of $Cu_xIn_yGa_zSe_n$ precursor films and powders utilizing an aqueous acidic bath composition comprising the following: $CuCl_2$, $H_2SeO_3$, $InCl_3$, $GaCl_3$, and LiCl; $CuCl_2$, $H_2SeO_3$, $InCl_3$, and LiCl; $H_2SeO_3$, $InCl_3$, $GaCl_3$, and LiCl; $H_2SeO_3$, $InCl_3$ and LiCl; and $CuCl_2$, $H_2SeO_3$, LiCl.

Figure 4:
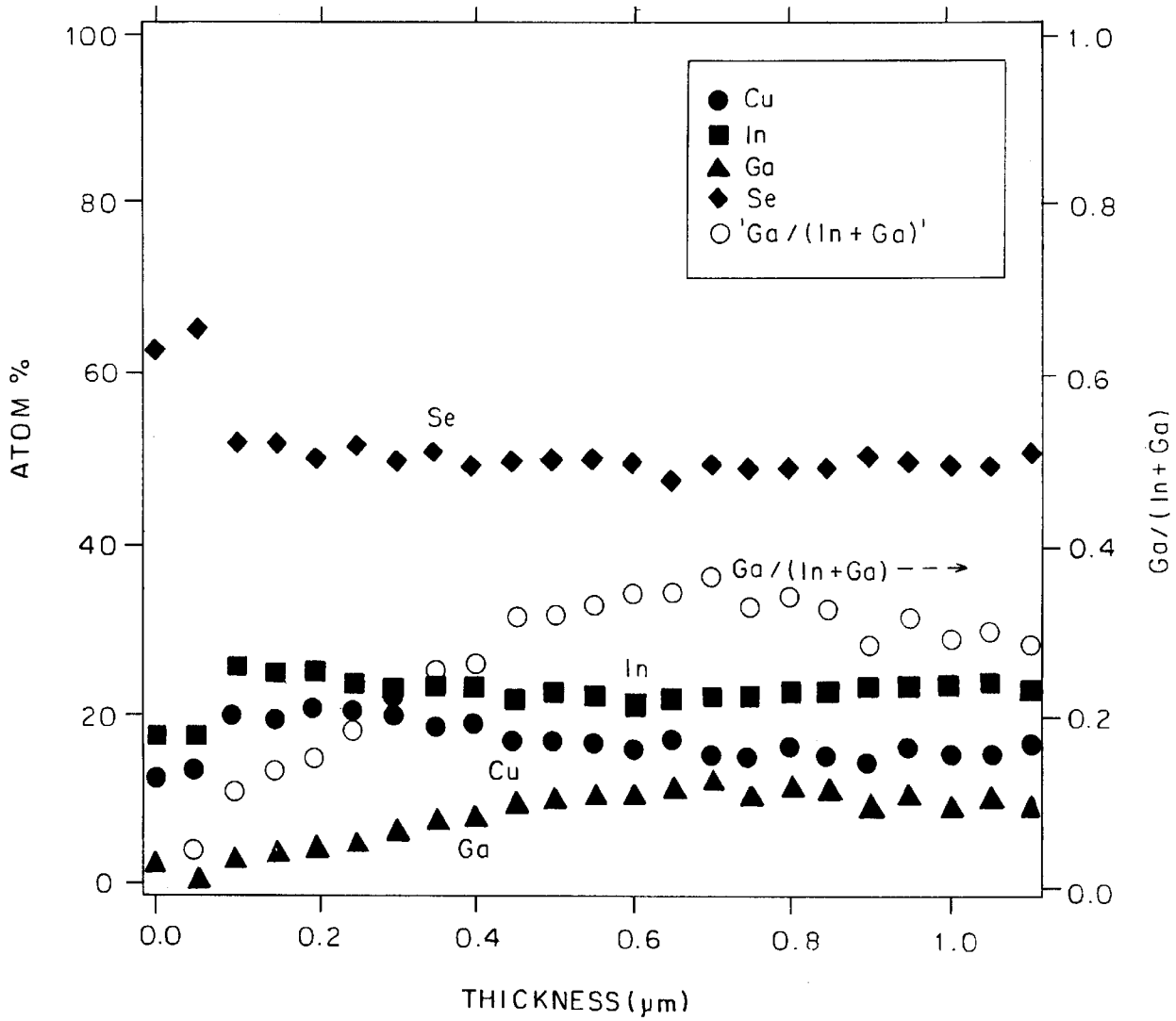
FIG. 4 is a graph depicting auger analysis data of the absorber layer prepared from electroless precursor.

FIG. 4 shows auger analysis data of the absorber layer prepared from electroless precursors.

Figure 5A:
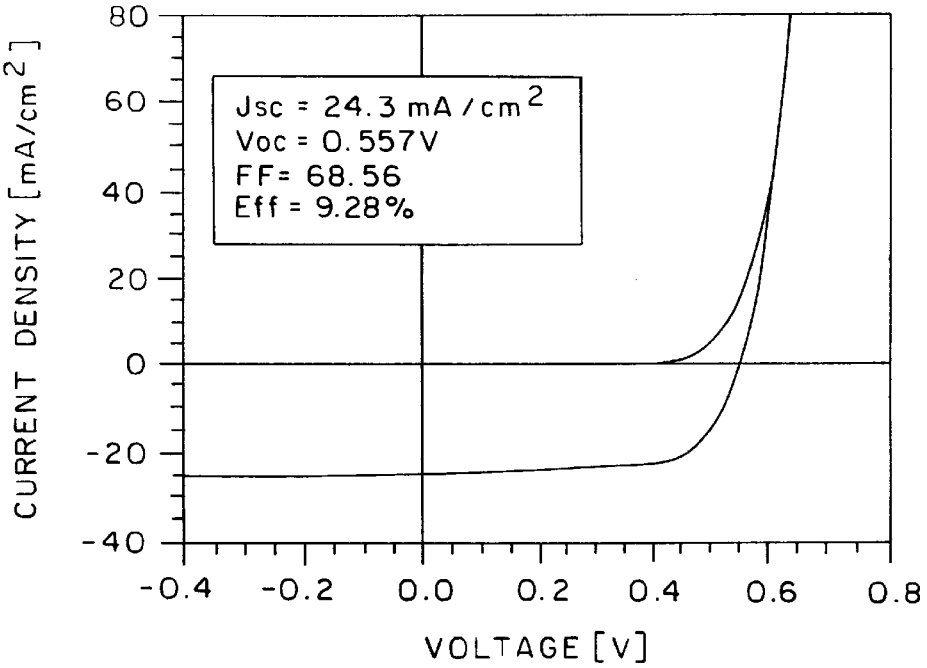
FIG. 5*a* is a graph depicting current density versus voltage and FIG. 5*b* is a graph showing external QE versus wavelength for a device prepared from electroless precursor films of $Cu_xIn_yGa_zSe_n$.
Figure 5B:
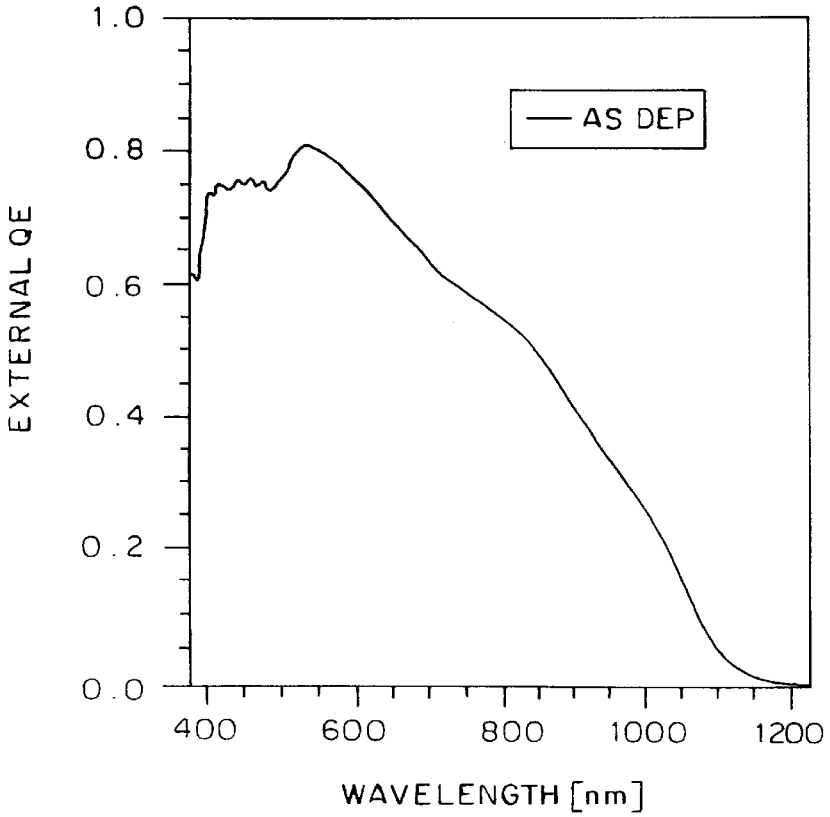

FIG. 5*a* shows a graph depicting the current density versus voltage and FIG. 5*b* is a graph showing external QE versus wavelength for a device prepared from electroless precursor films of $Cu_xIn_yGa_zSe_n$.

While the invention has been described in what is considered a preferred embodiment, other variations and modifications will become apparent to those skilled in the art It is intended, therefore, that the invention not be limited to the illustrative embodiments, but be interpreted within the full spirit and scope of the appended claims.

We claim:

1. A method for electroless deposition of $Cu_xIn_yGa_zSe_n$ (x=0–2, y=0–2, z=0–2, n=0–3) precursor films and powders onto a metallic substrate without the need of any external current or voltage source comprising:

preparing an aqueous bath solution of a mixture selected from the group consisting of:

I) a copper compound, a selenium compound, an indium compound and a gallium compound;

II) a copper compound, a selenium compound and an indium compound;

III) a selenium compound, an indium compound and a gallium compound;

IV) a selenium compound and a indium compound; and

V) a copper compound and selenium compound; each compound being present in sufficient quantity to react with each other to produce $Cu_xIn_yGa_zSe_n$ (x=0–2, y=0–2, z=0–2, n=0–3)

adjusting the pH of said aqueous bath solution to an acidic value by the addition of a dilute acid thereby initiating an electrochemical reaction by oxidizing a counterelectrode for a sufficient time to produce electrons internally to cause a deposit of $Cu_xIn_yGa_zSe_n$ (x=0–2, y=0–2, z=0–2, n=0–3) from said aqueous bath solution onto a metallic substrate.

2. The process of claim 1 wherein said metallic substrate is selected from the group consisting of molybdenum, a glass substrate coated with molybdenum, and silver, and said oxidizing counterelectrode is selected from the group consisting of iron, zinc or aluminum and their foils.

3. The method of claim 1 wherein said aqueous bath composition comprises a copper compound, a selenium compound, an indium compound and a gallium compound, each in a sufficient quantity to react with each other to produce $CuIn_{0.40}Ga_{0.31}Se_{2.17}$; said acidic value is 2.4; said counterelectrode is iron foil; said metallic substrate is molybdenum and said deposit is $CuIn_{0.40}Ga_{0.31}Se_{2.17}$.

4. The method of claim 1 wherein said aqueous bath composition comprises a copper compound, a selenium compound, an indium compound, and a gallium compound, each in sufficient amount to react with each other to produce $CuIn_{0.34}Ga_{0.11}Se_{1.99}$; said acidic value is 2.24; said counter electrode is iron foil; said metallic substrate is molybdenum and said deposit is $CuIn_{0.34}Ga_{0.11}Se_{1.99}$.

5. The method of claim 1 wherein said aqueous bath composition comprises a copper compound, a selenium compound, an indium compound, and a gallium compound, each in sufficient amount to react with each other to produce $CuIn_{0.54}Ga_{0.81}Se_{1.82}$; said acidic value is 2.5; said counterelectrode is zinc foil; said metallic substrate is molybdenum and said deposit is $CuIn_{0.54}Ga_{0.81}Se_{1.82}$.

6. The method of claim 1 wherein said aqueous bath composition comprises a copper compound, a selenium compound, and an indium compound, each in sufficient amount to react with each other to produce $CuIn_{2.39}Se_{2.82}$; said acidic value is 2.75; said counterelectrode is zinc foil; said metallic substrate is molybdenum, and said deposit is $CuIn_{2.39}Se_{2.82}$.

7. The method of claim 1 wherein said aqueous bath composition comprises a copper compound, a selenium compound, and an indium compound, each in sufficient amount to react with each other to produce $CuIn_{1.48}Se_{2.17}$; said acidic value is 2.5; said counterelectrode is iron foil; said metallic substrate is molybdenum, and said deposit is $CuIn_{1.48}Se_{2.17}$.

8. The method of claim 1 wherein said aqueous bath composition comprises a selenium compound, an indium compound, and a gallium compound, each in sufficient amount to react with each other to produce $InGa_{1.78}Se_{3.12}$; said acidic value is 2.5; said counterelectrode is zinc foil; said metallic substrate is molybdenum and said deposit is $InGa_{1.78}Se_{3.12}$.

9. The method of claim 1 wherein said aqueous bath composition comprises a selenium compound, an indium compound, and a gallium compound, each in sufficient amount to react with each other to produce $InGa_{2.69}Se_{8.69}$; said acidic value is 2.55; said counterelectrode is iron foil; said metallic substrate is molybdenum and said deposit is $InGa_{2.69}Se_{8.69}$.

10. The method of claim 1 wherein said aqueous bath composition comprises a selenium compound, an indium compound, and a gallium compound, each in sufficient amount to react with each other to produce $InGa_{0.54}Se_{47}$; said acidic value is 2.55; said counterelectrode is iron foil; said metallic substrate is silver and said deposit is $InGa_{0.54}Se_{4.7}$.

11. The method of claim 1 wherein said aqueous bath composition comprises a selenium compound, and an indium compound, each in sufficient amount to react with each other to produce $InSe_{2.20}$; said acidic value is 2.66; said counterelectrode is iron foil; said metallic substrate is molybdenum and said deposit is $InSe_{2.20}$.

12. The method of claim 1 wherein said aqueous bath composition comprises a selenium compound, and an indium compound, each in sufficient amount to react with each other to produce $InSe_{1.77}$; said acidic value is 2.66; said counterelectrode is iron foil; said metallic substrate is silver and said deposit is $InSe_{1.77}$.

13. A method of claim 1 wherein said aqueous bath composition comprises a selenium compound, and an indium compound, each in sufficient amount to react with each other to produce $InSe_{1.25}$; said acidic value is 2.65; said counterelectrode is zinc foil; said metallic substrate is silver and said deposit is $InSe_{1.25}$.

14. The method of claim 1 wherein said aqueous bath composition comprises a selenium compound, and an indium compound, each in sufficient amount to react with each other to produce InSe; said acidic value is 2.65; said counterelectrode is zinc foil; said metallic substrate is molybdenum and said deposit is InSe.

15. The method of claim 1 wherein said aqueous bath composition comprises a copper compound, and a selenium compound, each in sufficient amount to react with each other to produce $CuSe_{2.34}$; said acidic value is 2.54; said counterelectrode is zinc foil; said metallic substrate is molybdenum and said deposit is $CuSe_{2.34}$.

16. The method of claim 1 wherein said aqueous bath composition comprises a copper compound, and a selenium compound, each in sufficient amount to react with each other to produce $CuSe_{1.30}$; said acidic value is 2.75; said counterelectrode is iron foil; said metallic substrate is molybdenum and said deposit is $CuSe_{1.30}$.

17. The method of claim 1 wherein said aqueous bath composition comprises a copper compound, an indium compound, a gallium compound, and a selenium compound, each in sufficient amount to react with each other to produce $CuIn_{0.42}Ga_{0.38}Se_{2.04}$; said acidic value is between about 1.2 and about 2.6; said counterelectrode is iron foil; said metallic substrate is molybdenum and said deposit is $CuIn_{0.42}Ga_{0.38}Se_{2.04}$.

18. The method of claim 1 wherein said aqueous bath composition comprises a selenium compound and an indium compound, each in sufficient amount to react with each to produce $In_2Se_3$; said acidic value is between about 1.2 and about 2.4; said counterelectrode is iron foil; said metallic substrate is molybdenum and said deposit is $In_2Se_3$.

19. The method of claim 1 wherein said aqueous bath composition comprises a copper compound and a selenium compound, each in sufficient amount to react with each to produce $Cu_{1.75}Se$; said acidic value is between about 1.2 and about 2.4; said counterelectrode is zinc foil; said metallic substrate is molybdenum and said deposit is $Cu_{1.75}Se$.

* * * * *